United States Patent [19]

Hoffmann et al.

[11] 4,104,008

[45] Aug. 1, 1978

[54] PUMP HAVING FLUID-ACTUATED MOTOR CONTROLLED BY FLUID-ACTUATED DISTRIBUTOR

[75] Inventors: Ernst Hoffmann, Braunlage; Siegfried Reimann; Heinz Aschermann, both of Walkenried, all of Germany

[73] Assignee: Schmidt Kranz & Co., Zorge, Sudharz, Germany

[21] Appl. No.: 805,077

[22] Filed: Jun. 9, 1977

[30] Foreign Application Priority Data

Jun. 16, 1976 [DE] Fed. Rep. of Germany ..... 2626954

[51] Int. Cl.[2] ..... F04B 17/00; F04B 35/00; F01L 25/06

[52] U.S. Cl. ..... 417/397; 417/401; 417/404; 91/306; 91/307; 91/309; 91/313

[58] Field of Search ..... 417/397, 401, 402, 403, 417/404; 91/306, 307, 309, 313, 319

[56] References Cited

U.S. PATENT DOCUMENTS

| | | | |
|---|---|---|---|
| 636,718 | 11/1899 | Christie et al. | 91/309 |
| 2,201,248 | 5/1940 | Stone | 91/309 |
| 2,948,223 | 8/1960 | Mashinter | 417/387 |
| 3,174,409 | 3/1965 | Hill | 417/403 |
| 3,963,383 | 6/1976 | Hill | 417/401 |

FOREIGN PATENT DOCUMENTS

| | | | |
|---|---|---|---|
| 1,813,145 | 2/1970 | Fed. Rep. of Germany | 417/401 |

*Primary Examiner*—Carlton R. Croyle
*Assistant Examiner*—Thomas I. Ross
*Attorney, Agent, or Firm*—Michael J. Striker

[57] ABSTRACT

A fluid-actuated, such as a pneumatically actuated, hydraulic pump of either the single acting or the double acting type is controlled in its operation by a main valve member which has two connecting compartments the fluid in one of which is always at the atmospheric, and in the other always at a superatmospheric, pressure. The main valve member has two end faces, one larger than the other, the smaller being always acted upon by the superatmospheric pressure of the fluid and the larger one intermittently. An auxiliary valve member controls the admission of the pressurized fluid to the larger end face and is open only during the reversal of the hydraulic pump from suction to pumping stroke, while the pressure acting on the larger end face is relieved during reversal from the pumping to the suction stroke. A duct communicates one or the other of the connecting compartments of the main valve member which an actuating compartment of an actuating unit, depending on the position of the main valve member. In a single acting pump, the pressure relief of the larger end face is accomplished by a guiding element reciprocating with the hydraulic pump and permitting pressure relief only during reversal from the pumping to the suction stroke. In a double acting pump, an additional auxiliary valve member controls the pressure relief during such reversal. In the double acting pump, a channel communicates the other actuating compartment either with the one connecting compartment or with a control compartment delimited by the smaller end face of the main valve member.

18 Claims, 4 Drawing Figures

PUMP HAVING FLUID-ACTUATED MOTOR CONTROLLED BY FLUID-ACTUATED DISTRIBUTOR

BACKGROUND OF THE INVENTION

The present invention relates to fluid-actuated pumps in general, and more particularly to pneumatically actuated hydraulic pumps.

There is already known a variety of different pneumatically actuated pumps, such as hydraulic pumps, either of the single acting or of the double acting type. In such pumps there are usually provided interconnected reciprocating actuating and pumping pistons both being accommodated in their own chambers and the actuating piston having a larger active area than the pumping piston. The reciprocation of the actuating piston is controlled by a control valve which has a plurality of circumferential lands that separate individual connecting compartments from one another and also from control compartments provided at the one or the other end face of the control valve. Depending on the position of the control valve, one or both of the actuating compartments located to the two sides of the actuating piston are alternatingly supplied with pressurized fluid, or relieved of pressure, in that one of the connecting compartments permanently communicates with a source of a pressurized actuating fluid, while the other connecting compartment is permanently maintained at an atmospheric pressure. In this context, it is also already known to employ an auxiliary control valve which permanently communicates with the source of the pressurized actuating fluid and which has a displacing portion which extends into one of the actuating compartments and into the path of movement of the actuating piston to be displaced by the latter.

The heretofore known constructions of hydraulic pumps of this type are very complicated with respect to the pneumatically actuated part and the associated control arrangement and, therefore, such constructions are prone to malfunction. The control valve is relatively long and is provided, at the circumference thereof, with a plurality of mutually axially spaced lands equipped with sealing rings, as well as a plurality of annular compartments separated from one another by such lands. The control valve of the conventional construction is provided by an axial bore which extends over almost the entire length of the control valve, while two spaced radial bores each communicate the axial bore with one of the circumferential compartments. The axial bore serves solely the purpose of removal of expended air. The movement of the control valve by means of compressed air is achieved, on the one hand, by means of a peripheral annular surface and, on the other hand, by means of that end face of the control valve which is diametrally opposite to the port of the axial bore. Corresponding to the number of the circumferential annular compartments, there is needed a corresponding number of bores or annular grooves in the housing of the control valve. As a result of this, the control arrangement is very complicated and expensive, which has the disadvantageous effect of making the dimensions of the hydraulic pump with the associated equipment large and thus limiting the utility of the hydraulic pump to only some applications. A further disadvantage is to be seen in the fact that a separate and differently configurated control arrangement must be designed and manufactured, on the one hand, for a single acting pump and, on the other hand, for a double acting pump. As a result of this, the manufacture of the hydraulic pump is rendered more expensive and the keeping of the individual components in stock is rendered more difficult. In addition thereto, even the hydraulic part of the pump is complicated and, as a result of this, prone to malfunction, in that it usually consists of forged or wrought T-pieces or double-T-pieces with incorporated suction and pressure valves, which can only be manufactured with the necessary precision on special machines.

SUMMARY OF THE INVENTION

Accordingly, it is a general object of the present invention to avoid the disadvantages of the prior art.

More particularly, it is an object of the present invention to devise a fluid-operated pump which is not possessed of the disadvantages of the prior-art pumps.

Still another object of the present invention is to provide a pneumatically operated hydraulic pump which is simple in construction, reliable in operation and inexpensive nevertheless.

A concomitant object of the present invention is to so construct the pneumatically actuated hydraulic pump as to have only a small number of simple and reliably operating components, both at the actuating side and on the pumping side thereof.

A yet further object of the present invention is to so design the pump as to have small overall dimensions for a given output thereof.

Finally, it is an object of the present invention to so construct a control arrangement for the actuating part of the pump as to be usable, with only a small modification, both in single acting and double acting pumps.

In pursuance of these objects and others which will become apparent hereafter, one feature of the present invention resides, in a fluid-actuated pump, briefly stated, in a combination comprising at least one pumping unit including a pumping chamber, a pumping piston received in said pumping chamber for reciprocation to one end position in a suction stroke and to another end position in a pumping stroke, and means for admitting a medium to be pumped into said pumping chamber during said suction stroke and for discharging the medium being pumped from said pumping chamber during said pumping stroke; an actuating unit including an actuating chamber and an actuating piston subdividing said actuating chamber into two actuating compartments and connected to said pumping piston for joint reciprocation; a source of pressurized actuating fluid; a sink for the actuating fluid; and means for alternately communicating at least one of said actuating compartments with said source and said sink, including a main valve having a control chamber and an elongated main valve member mounted in said control chamber for movement between an extended and a retracted position and having a large first end face facing a first, and a smaller second face facing a second, control compartment into which said main valve member subdivides said control chamber, and a first and a second connecting compartment at the circumference of said main valve member intermediate said end faces and separate from each other and from said control compartments. The communicating means further includes first duct means permanently communicating said second connecting and control compartments with said source for the pressurized actuating fluid to urge said main valve member toward said extended position thereof, second duct means communicating said first connecting compartment with said sink, third duct means communicating said source with said first control compartment, an auxiliary valve member interposed in said third duct means for displacement from a closed toward and open position, means for displacing said auxiliary valve member toward said open position thereof when said pumping piston is at said one end position thereof, fourth duct means communicating said first control compartment with said sink when said pumping piston is at said other position thereof, and fifth duct means communicating said one actuating compartment with said second connecting compartment in said retracted, and with said first connecting compartment in said extended, position of said main valve member. Preferably, the above-mentioned medium is a liquid and the above-mentioned fluid is a gas, such as compressed air, and then the active area of said actuating piston considerably exceeds that of said pumping piston.

In a currently preferred embodiment of the present invention, said first connecting compartment is closer to said second control compartment than said second connecting compartment, and the first duct means includes a duct in said main valve member which bypasses said first connecting compartment and communicates said second control and connecting compartments with one another.

Consequently, as far as the control arrangement is concerned, it has been achieved by the present invention that the construction obtained thereby, including the most important components thereof, is suited for use either as a single acting or as a double acting pump. The control is constructed in a simple and distinct manner and possesses comparatively small dimensions. As a result of this, it is possible to manufacture the pumps equipped with this control arrangement smaller for the same output than the heretofore known pumps.

The main valve member is very short and possesses, at its circumference, only two annular compartments separated from one another by lands, by means of which connecting compartments the reversing functions for the pneumatic actuating piston can be performed in a reliable manner either in a single acting or in a double acting pump. Furthermore, the duct in the main valve body, preferably constructed as an axial bore, is relatively short, extending through the main valve member to an extent only slightly extending a half of the length of the main valve member. The axial bore has a port which is located at the small end face of the main valve body, the small end face being constantly acted upon by the compressed air. As a result of this, even the axial bore is always in communication with the source of the pressurized air. On the other hand, the action of the pressurized air on the larger end face provided at the opposite longitudinal end of the main valve member from the small end face, is controlled in dependence on the operating position of the auxiliary valve member and thus in dependence on the position of the actuating piston. This is particularly true when, according to another aspect of the present invention, the displacing means includes a displacing portion of the auxiliary valve member which extends into said one actuating compartment and into the path of reciprocation of said actuating piston to be displaced by the latter toward said open position when said pumping piston approaches said one end position. Under these circumstances, the actuating piston displaces the auxiliary valve member and thus admits the pressurized air to the larger end face of the main valve member, or relieves the pressure acting on the larger end face of the main valve member. The main valve member is guided in a cylindrical bore of either the pump housing or of a discrete control housing, with which there are in communication only the relief channel for the actuating fluid, a connecting channel to the one actuating compartment, and a connecting conduit to the auxiliary valve member, as far as a single acting pump is concerned. In a double acting pump, even the other actuating compartment is connected to the cylindrical control chamber accommodating the main valve member by a connecting channel. The larger end face constitutes a part of a grooved land of an enlarged diameter which is accommodated in an enlarged end portion of the cylindrical control chamber.

In order to assure that, during the movement of the relief port, there is obtained a reliable sealing effect between the components of the control arrangement which communicate with the source and with the sink, respectively it is proposed, according to a currently preferred concept of the present invention, to separate the two annular connecting compartments from one another by three mutually parallel radial lands, and two sealing rings respectively accommodated between the three lands and axially fixed thereby.

The function of the two annular connecting compartments which immediately follow one another in the longitudinal direction of the main valve member, is exactly predetermined. While the first connecting compartment which is located adjacent the smaller end face is always in communication with the sink, such as the ambient atmosphere, regardless of the instantaneous position of the main valve body, that is, it serves to release the actuating fluid from the actuating compartment of the actuating unit, the other annular connecting space is permanently connected, via the above-mentioned duct, such as axial and radial bores in the main valve member, with the source of the pressurized actuating fluid. In this connection, it is further advantageous according to the present invention that the first connecting compartment is longer than the second connecting compartment so as to be always in communication with a conduit communicating with the sink. While one radial bore is sufficient, a plurality of such radial bores may be provided, being located in a common plane and extending radially between the axial bore and the second connecting compartment.

When the above-discussed control arrangement is used in a hydraulic pump which is single acting and where a resiliently yieldable arrangement, such as a helical spring, is used for returning the actuating piston towards its initial end position, it is proposed by the present invention to equip the actuating piston with a guiding element, such as a pin, which is received in and slides in a cylindrical receiving chamber of the pump housing. The guide pin serves to stabilize the actuating piston, together with the hydraulic piston which reciprocates in a corresponding pumping chamber of the hydraulic pumping unit.

In addition thereto, the cylindrical receiving chamber for the guide pin of the actuating piston has the purpose of rendering escape of the actuating fluid from the first control compartment possible. To this end, the present invention proposes that the duct which communicates with the first control compartment communicate with the cylindrical receiving chamber of the pump housing. As a result of this, the guide pin not only constitutes a stabilization member for the pneumatic actuating piston, but also represents a closing member which obstructs the escape route of the pressurized actuating fluid from the first control compartment during a large part of the axial movement of the actuating piston.

According to a further concept of the present invention, the pumping unit includes a pumping casing which is accommodated in said pump housing and has an extension extending to the exterior of said pump housing. Then, the admitting and discharging means includes a valve casing, an admitting and discharging valve accommodated in said valve casing, and means for detachably connecting said valve casing to said extension of said pumping casing, including a passage in said valve casing for fittingly receiving said extension. Thus, the pumping casing of the hydraulic pumping unit constitutes a detachable component of the pump housing. The extension emerging out of the pump housing is preferably cylindrical in configuration, and the valve casing with the admitting and discharging valve is then slid over the extension, enclosing an angle of 90° therewith, and arrested thereon in the proper position. In the event that the pump is double acting, it is to be understood that even the pumping casing of the second pumping unit has a similar extension which emerges from the pump housing at the opposite side thereof. Then, similarly to what has been explained above in connection with a single acting pump, another valve casing is slid over and arrested to the other extension. The admitting valves, on the one hand, and the discharging valves, on the other hand, of each side can communicate with the same conduits.

It is of a particular advantage in this connection when said connecting means includes a pair of connecting elements each being of a doubly-conical configuration and each having a central channel communicating the interior of said extension with the interior of said valve casing at said admitting valve and at said discharging valve respectively, and a pair of threaded members each respectively pressing one of said connecting elements into contact with said extension of said pumping casing. After the sliding of the valve casing over the extension of the pumping casing, or of the two valve casings over the two extensions, the connecting elements, which are conical at their ends and cylindrical at the center portions thereof, are introduced through the hollow threaded portions of the valve casing and are inserted, by one of the conical end portions of each, in a correspondingly configurated recess provided at the circumference of the extension of the pumping casing. The cylindrical center portion of the respective connecting element is received in a corresponding bore of a transverse portion of the valve casing. Subsequently, the respective connecting element is held in a proper position by means of the respective threaded member which is threaded into the threaded portion of the valve casing and which possesses, at its free end, a conically configurated recess which comes into contact with the second conical end portion of the respective connecting element. In this manner, the valve casing is sealingly connected to the extension of the pumping casing, without additional threaded connections.

This results in a very advantageous situation wherein the conical connecting elements reliably seal the hydraulic pumping chamber relative to the threaded members. What is achieved thereby is that the hydraulic medium is confined in a system of bores having relatively small diameters. This has a further advantage that the pressure forces, as a result of the small diameters and small affected surfaces, do not become exceedingly great and, as a result thereof, the various components can be made with walls having relatively small thicknesses. Similarly configurated, assemblable constructions, are already known, but the valve casing for the admitting and discharging valves is sealed, in the transverse bore, by means of O-rings and supporting rings. These O-rings and supporting rings, however, are exposed to high loads at high pressures especially in pulsing operation. Furthermore, it is known to build the valve casing together with the pumping casing from a single forged or wrought T-piece or double-T-piece. Even in this construction, the hydraulic fluid is confined in bores of relatively small diameters. However, the forged pieces can only be manufactured which much more difficulty than those of the assembled construction according to the present invention. The latter construction, furthermore, has the significant advantage that all of the individual components can be manufactured from stock material on automatically operating material-removing machines, such as lathes. In addition thereto, it is reliably avoided that the hydraulic medium could escape from the circuit therefor.

In the case of a double acting actuating piston to which there are connected two hydraulic pumping pistons extending to opposite sides of the actuating piston, there are provided two auxiliary valve members having displacing portions each of which extends into one of the actuating compartments and into the terminal portion of the path of reciprocation of the actuating piston at the two end positions thereof. Under these circumstances, it is advantageous according to a further facet of the present invention that the above-mentioned fourth duct means communicates with the sink via the additional auxiliary valve member. Then, the communicating means of the present invention further comprises sixth duct means communicating said other actuating compartment with said source in said extended, and with said first connecting compartment in said retracted, position of said main valve member.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
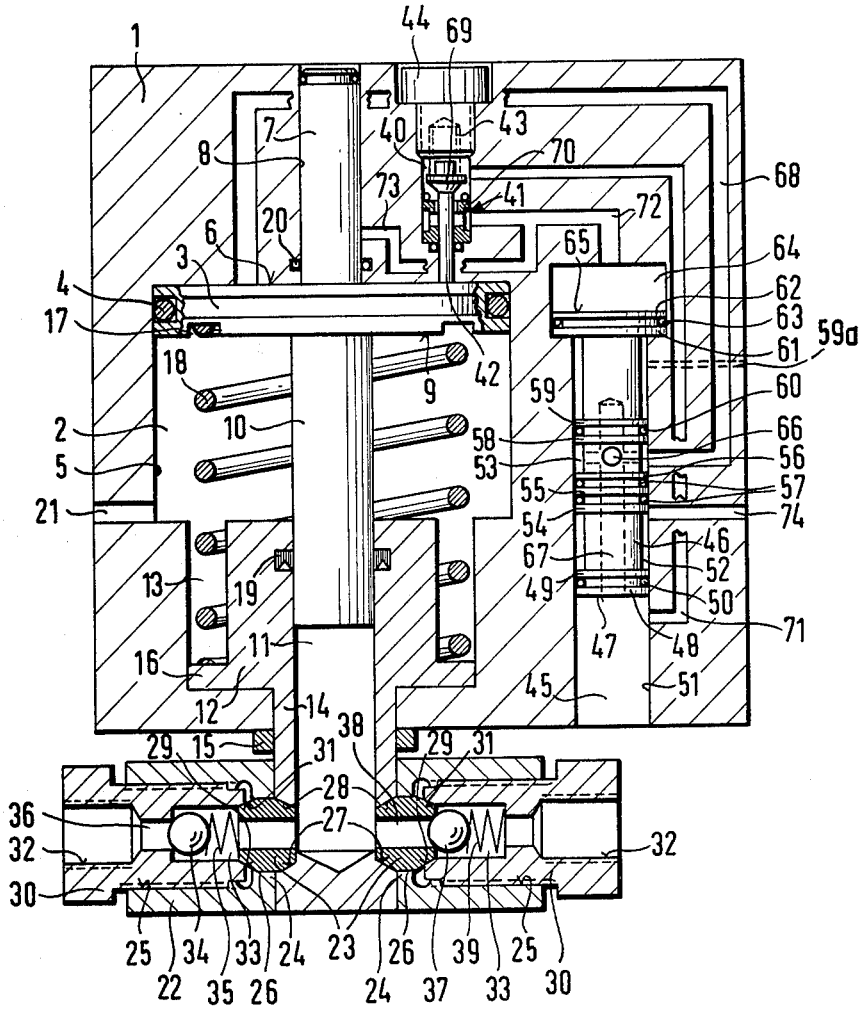
FIG. 1 is a somewhat diagrammatic sectioned side elevational view of a single acting pump according to the present invention in one end position.
Figure 2:
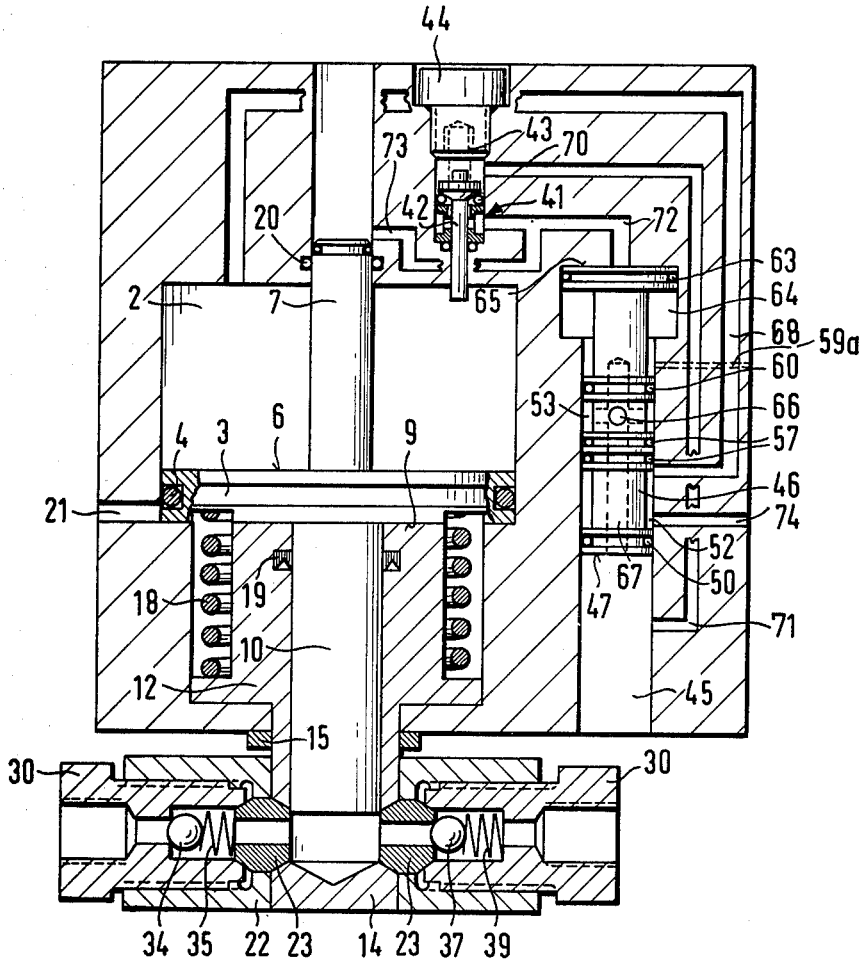
FIG. 2 is a view similar to FIG. 1 but in another end position.

Referring now to the drawing in detail, and first to FIGS. 1 and 2 thereof, it may be seen that the reference numeral 1 indicates a pump housing which is provided with an approximately centrally located actuating chamber 2. An actuating piston 3 which has a relatively large diameter but is relatively thin, is mounted in the actuating chamber 2 for reciprocation in response to admission of pressurized air thereto. The actuating compartment 2 is bounded by a surface 5, and the actuating piston 3 has mounted thereon a sealing ring 4 which sealingly contacts the surface 5.

The actuating piston 3 is provided, at its side 6, with a guide pin 7 which is received for sliding in a cylindrical receiving chamber 8 of the pump housing 1. The receiving chamber 8 is in communication with the ambient atmosphere. The actuating piston 3 is connected, at its other side 9, with a cylindrical hydraulic pumping piston 10 which is received for sliding in a cylindrical pumping chamber 11 of a hydraulic pumping casing 12.

The hydraulic pumping casing 12 is received in a recess 13 of the pump housing 1 constituting a continuation of the actuating chamber 2, and has a shaft-shaped extension 14 which emerges out of the pump housing 1 to one side thereof. The connection of the hydraulic pumping casing 12 to the pump housing 1 is achieved by means of a connecting ring 15. Between an annular flange 16 of the hydraulic pumping casing 12 and an annular groove 17 in the actuating piston 3, there is provided a helical compression spring 18. The hydraulic pumping casing 12 is sealed relative to the hydraulic pumping piston 10 by means of a seal 19, and the guide pin 7 for the actuating piston 3 is sealed with respect to the pump housing 1 by means of a seal 20. The reference numeral 21 designates a venting bore communicating the actuating chamber 2 with the exterior of the pump housing 1.

The extension 14 of the hydraulic pumping casing 12, extending out of the pump housing 1, is introduced into a valve casing 22. The longitudinal axes of the hydraulic pumping casing 12 and of the valve casing 22 intersect with one another at a right angle. The connection of the valve casing 22 to the extension 14 of the pumping casing 12 is achieved by means of doubly-conical coupling or connecting elements 23. For this purpose, there are provided, in two transverse walls 24 of the valve casing 22, at internally threaded portions 25 thereof, bores 26 into each of which there is introduced a cylindrically configurated center portion of one of the connecting elements 23. One of the two conical end portions, for instance, 27, of the respective connecting element 23, is accommodated in a correspondingly conically configurated recess 28 provided at the circumference of the extension 14, while the other conical end portion 29 extends into the threaded portion 25 of the valve casing 22. Threaded members 30 are then threaded into the above-mentioned threaded portions 25, each of such threaded members 30 being provided, at its leading end, with a conical inner surface 31 which comes into contact with the conical end portion 29 of the connecting element 23 during the tightening of the threaded member 30. In this manner, the valve casing 22 is sealingly connected to the shaft-shaped extension 14 of the pumping casing 12.

As can be further ascertained from the drawing, the connecting members 30 are provided, at their trailing end portions, with inwardly threaded sections 32 for connecting hydraulic conduits thereto, and in a continuation of each of such sections 32, with central bores 33 in which there are arranged the suction or pressure valves, respectively. While on the one side (left side of the drawing), a ball 34 is pressed by a spring 35 against a port of a further cylindrical bore 36 of the threaded member 30, the spring 35 resting against the connecting member 23, a ball 37 is accommodated in the other threaded member 30 and pressed by a compression spring 39 against a portion of a transfer bore 38 in the connecting member 23. The other end of the compression spring 39 rests against the inner end face of the threaded member 30.

An auxiliary valve member 41 is located in a corresponding recess 40 of the pump housing 1 and extends parallel to the longitudinal axis of the actuating piston 3 which coincides with that of the hydraulic pumping piston 10. The auxiliary valve member 41 has a displacing portion 42 which is capable of extending into the actuating chamber 2, being urged into such position by a helical compression spring 43 which abuts, at its free end, against a seting screw 44. The auxiliary valve member 41 is sealed with respect to the actuating compartment 2.

Parallel to the longitudinal axis of the auxiliary valve member 41 and to that of the actuating piston 3 and the pumping piston 10, there is received in a further cylindrical recess 45 of the pump housing 1 or of a discrete control housing (for the sake of simplicity, pump housing 1 has been selected), a main valve member 46 for axial movement. The channel-shaped cylindrical recess 45 is in direct communication with a conventional source of compressed air which has not been illustrated.

The main valve body 46 has a small end face 47, the outer diameter of which corresponds to the diameter of the admission channel 45. The end face 47 constitutes a part of a radially projecting land 48 which, together with a further land 49, axially fixes a sealing ring 50 in place, the sealing ring 50 sealingly contacting an inner surface 51 bounding the channel 45. An annular connecting compartment 52 immediately adjoins the land 49, the annular connecting compartment 52 being separated from another annular connecting compartment 53 following the connecting compartment 52 in the axial direction of the main valve member 46, by three circumferentially extending radially projecting lands 54, 55 and 56, and by two axially fixed sealing rings 57 which also sealingly contact the surface 51 of the channel 45. The annular connecting compartment 53 is axially shorter than the annular connecting compartment 52. The annular connecting compartment 53 is delimited, at its other end, by a land 58 which, together with a further land 59, axially fixes a sealing ring 60 which sealingly contacts the surface 51 of the channel 45.

At an axial distance from the last-mentioned land 59, there are provided two further lands 61, 62 which are larger in diameter, the lands 61, 62 axially confining between each other a sealing ring 63. These lands 61, 62 slide in a control chamber which is increased in diameter relative to the channel 45, the land 62 being provided, at the axial end of the main valve member 46, with a large end face 65. The space between the land 59 and the land 61 may be communicated with the ambient atmosphere by a passage 59*a*.

Four radial bores 66, angularly distributed by 90° relative to one another, communicate with the shorter annular connecting compartment 53 and with a central axial bore 67. The axial bore 67 extends over somewhat more than a half of the length of the main valve member 46 an communicates with the channel 45 at the smaller end face 47.

In the operating position of the pump which is illustrated in FIG. 1, the compressed air flows through the channel 45 and through the axial bore 67 to the radial bore 66, and from there through the connecting compartment 53, a duct 68 to the one side 6 of the actuating piston 3, displacing the latter, against the force of the helical compression spring 18, toward the other end position which is illustrated in FIG. 2. During such displacement, the hydraulic pumping piston 10 performs a pumping stroke so that the hydraulic medium, which has been previously drawn into the pumping chamber 11 through the admitting valve 34, 35, is now discharged or pumped through the discharge valve 37, 39.

During the displacement of the actuating piston 3, the displacing portion 42 of the auxiliary valve member 49 move jointly with the actuating piston 3 until a disk 69 of the auxiliary valve member 41 sealingly contacts a seal 70. As a result of this, a duct 71, which is in permanent communication with the channel 45, is sealingly separated from a connecting duct 72 leading to the larger end face 65 of the main valve member 46. Thus, the source of compressed air communicates only with the channel 45 and thus acts on the smaller end face 47. However, the main valve member 46 cannot yet be displaced from the retracted position illustrated in FIG. 1 into the extended position illustrated in FIG. 2 in that the compressed air which is present in the control compartment 64 cannot escape through the duct 73 inasmuch as a port of this duct 73 is still obstructed by the guide pin 7 of the actuating piston 3. Only when the free end of the guide pin 7 clears the port of the duct 73 (see FIG. 2), the main valve member 46 is able to displace the air out of the control compartment 64 via the duct 73 and the cylindrical receiving chamber 8 to the exterior of the pump housing 1.

When this happens, the main valve member 46 is displaced into its extended position illustrated in FIG. 2. In this position, the duct 68 leading to the actuating chamber 2 of the actuating piston 3 is separated from the connecting compartment 53 and, after the clearance by the lands 54 to 56 separating the connecting compartments 52 and 53, the actuating chamber 2 is communicated, via the longer connecting compartment 52, with a discharge duct 74. Thus, the actuating chamber 2 of the actuating piston 3 communicates with the ambient atmosphere. The helical compression spring 18 can now become active and return the actuating piston 3 into the end position thereof which is illustrated in FIG. 1.

During such return displacement, the guide pin 7 of the pneumatic actuating piston 3 first obstructs the port of the channel 73 and thus interrupts communication thereof with the ambient atmosphere. Shortly before reaching the end position illustrated in FIG. 1, the actuating piston 3 contacts the displacing portion 42 of the auxiliary valve member 41 and displaces the same into its open position illustrated in FIG. 1. As a result of this, the compressed air present in the channel 45 can flow through the duct 71 and the duct 72 into the control compartment 64 to act at the larger end face 65 of the main valve member 46, thus displacing the latter into the position illustrated in FIG. 1. As a result of the displacement of the main valve member 46, the discharge duct 74 is separated from the channel 68 communicating with the actuating chamber 2. After the central lands 54 to 56 have cleared the port of this duct 68, the latter is connected, via the shorter annular connecting space 53, the radial bores 56, and the axial bore 67, with the channel 45 and the full cycle described above repeats itself.

Figure 3:
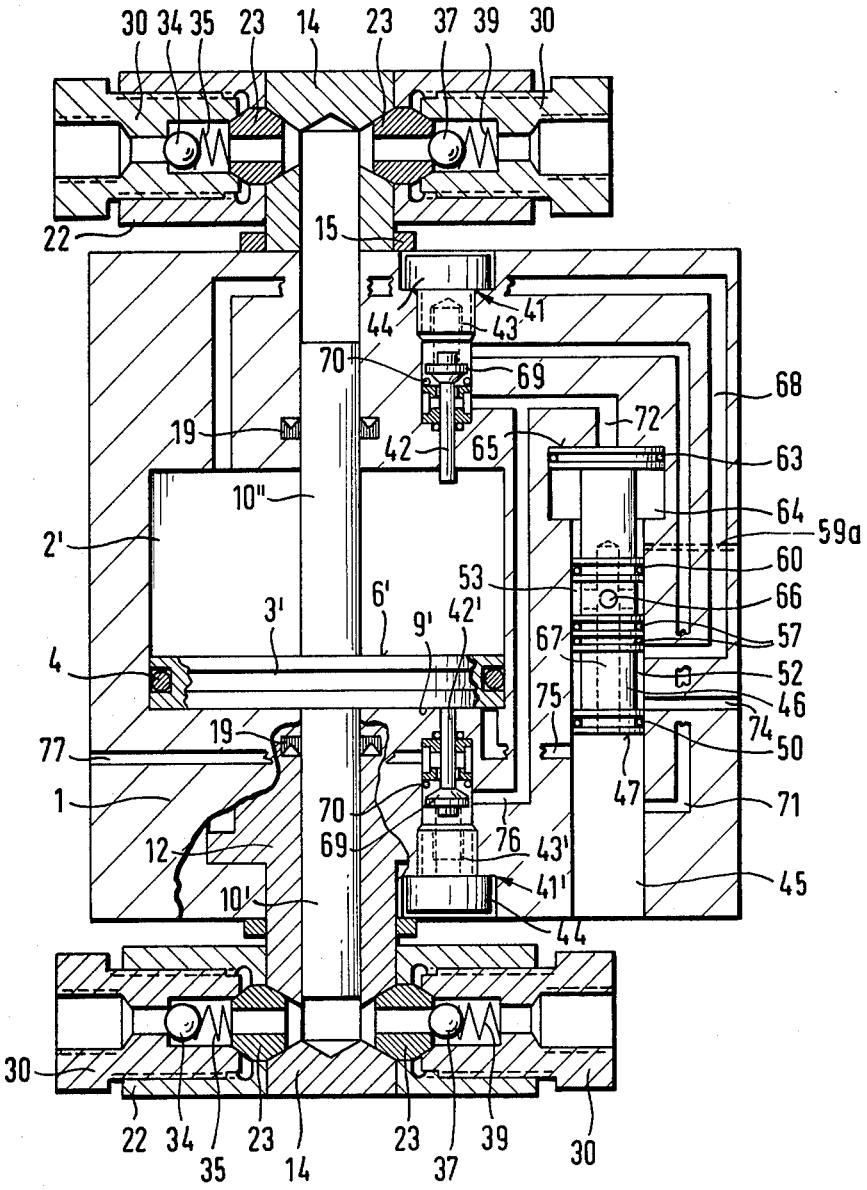
FIG. 3 is a view similar to FIG. 1 but of a double acting pump.
Figure 4:
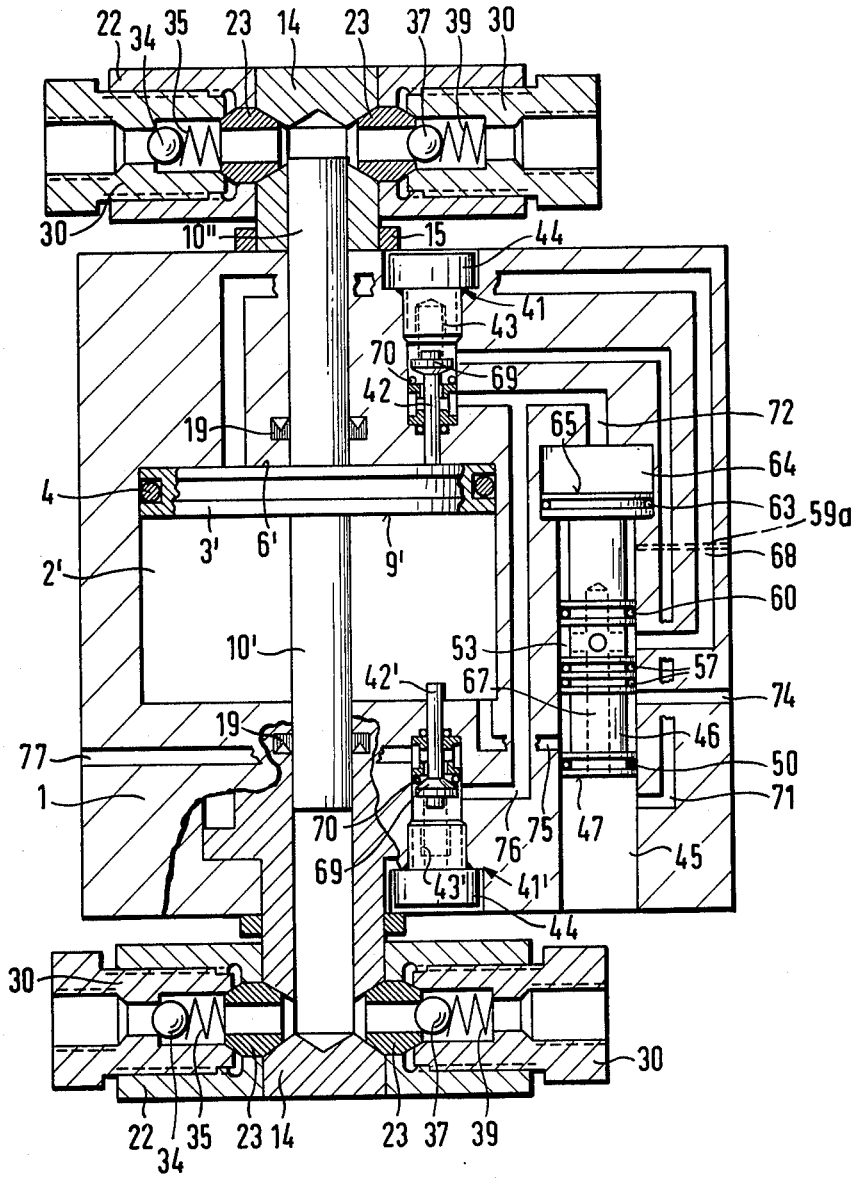
FIG. 4 is a view similar to FIG. 2 but of a double acting pump.

The double acting pump illustrated in FIGS. 3 and 4 also has a pump housing 1 which has a central actuating chamber 2' for a pneumatic actuating piston 3'. The actuating piston 3' is sealed by a peripheral seal 4 relative to the surface 5' bounding the actuating chamber 2'. To the two sides of the actuating piston 3', there extend two hydraulic pumping pistons 10', 10'' into corresponding hydraulic pumping casings 12 of which only the casing 12 associated with the pumping piston 10' is illustrated. Each of the pumping casings 12 has a shaft-shaped extension 14 extending to the exterior of the pump housing 1. The hydraulic pumping casing 12, the shaft-shaped extensions 14, and the valve casings 22 including the valve components thereof, mounted on these shaft-shaped extensions 14, are identical to those which have been discussed above with reference to FIGS. 1 and 2. Thus, a renewed discussion of these components can be dispensed with.

Also the construction of the main valve member 46 and its arrangement in the pump housing 1 identically corresponds to that of the embodiment of FIGS. 1 and 2. The only addition to the embodiment of FIGS. 1 and 2, which is encountered in the embodiment of FIGS. 3 and 4, is an additional auxiliary valve member 41', necessitated by the construction of the pump as a double acting pump, which additional auxiliary valve member 41' is provided at the other end of the actuating chamber 2'. However, even this additional auxiliary valve member 41' is constructed identically to the auxiliary valve member 41 which has been discussed above in connection with the embodiment of FIGS. 1 and 2.

In the illustration of FIG. 3, the compressed air in the compressed air admission channel 45 acts on the smaller end face 47 of the main valve member 46, having displaced the latter in the illustrated end position thereof. In this end position, the auxiliary valve member 41 is in its closed position so that the compressed air admitted to the auxiliary valve member 41 via the duct 71 cannot proceed to the larger end face 65 of the main valve member 46.

Furthermore, the compressed air acts on the side 9' of the pneumatic actuating piston 3', via the channel 45 and a duct 75 in the pump housing 1. The other side 6' of the pneumatic actuating piston 3' is in communication, via the duct 68 and the long annular connecting compartment 52, with the discharge conduit 74. As a result of this, the pneumatic actuating piston 3' can be moved into the other end position thereof which is illustrated in FIG. 4.

During such displacement, the displacing projection 42' of the additional auxiliary valve member 41' follows the displacement of the pneumatic actuating piston 3'. The additional auxiliary valve member 41' thus moves into its closed position illustrated in FIG. 4. Shortly before the pneumatic actuating piston 3' reaches its other position, it comes into contact with the displacing projection 42 of the auxiliary valve member 41 and displaces, via the displacing portion 42, the disk 69 so far against the return force exerted thereon by the helical compression spring 43, until the compressed air present in the duct 71 can reach the duct 72 through the auxiliary valve member 41 and thus be admitted to the larger end face 65 of the main valve member 46 to act thereon.

The main valve member 46 is displaced to its retracted position illustrated in FIG. 4, and the land 48 having the smaller end face 47, together with the land 49 and the sealing ring 50 confined therebetween, closes the duct 75 between the channel 45 and the actuating chamber 2'. Subsequently thereto, this duct 75 communicates, via the longer annular connecting compartment 52, with the discharge conduit 74.

Simultaneously therewith, the central lands 54 to 56 separate the duct 68 between the two annular connecting compartments 52 and 53 and the other end of the actuating chamber 2', from the discharge conduit 74 and connect the same instead with the shorter annular connecting compartment 53 and thus, via the radial bore 66 as well as the axial bore 67 in the main valve member 46, with the source of compressed air.

Subsequently thereto, the pneumatic actuating piston 3' is displaced again in direction toward the end position in FIG. 3. At the beginning of such a displacement, the displacing portion 42 of the auxiliary valve member 41 follows the displacement of the actuating piston 3' under the urging of the helical compression spring 43, and that for so long until the auxiliary valve member 41 reaches its closed position and separates the duct 71 from the duct 72. Even though the compressed air is now admitted only to the smaller end face 47, it cannot yet displace the main valve member 46 into the position illustrated in FIG. 3, inasmuch as the additional auxiliary valve member 41' is still in its closed position.

Only shortly before reaching the end position illustrated in FIG. 3, the pneumatic actuating piston 3' displaces the displacing portion 42' of the additional auxiliary valve member 41' from the position illustrated in FIG. 4 against the force exerted thereon by the helical compression spring 43' into the position illustrated in FIG. 3 and thus a duct 76 is connected with a discharging conduit 77 communicating with the ambient atmosphere. When this happens, the air confined in the control compartment 64 can escape through the ducts 72 and 76, through the additional auxiliary valve member 41' and the discharging channel 77, so that the main valve body 46 is displaced into the extended position illustrated in FIG. 3 and the entire cycle of operation of the double acting pump will be automatically repeated.

It will be understood that each of the elements described above, or two or more together, may also find a useful application in other types of constructions differing from the types described above.

While the invention has been illustrated and described as embodied in a pneumatically operated hydraulic pump, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a fluid-actuated pump, a combination comprising at least one pumping unit including a pump chamber, a pumping piston received in said pumping chamber for reciprocation to one end position in a suction stroke and to another end position in a pumping stroke, and means for admitting a medium to be pumped into said pumping chamber during said suction stroke and for discharging the medium being pumped from said pumping chamber during said pumping stroke; an actuating unit including an actuating chamber and an actuating piston subdividing said actuating chamber into two actuating compartments and connected to said pumping piston for joint reciprocation; a source of pressurized actuating fluid; a sink for the actuating fluid; and means for alternately communicating at least one of said actuating compartments with said source and said sink, including a main valve having a control chamber and an elongated main valve member mounted in said control chamber for movement between an extended and a retracted position and having a larger first end face facing a first, and a smaller second face facing a second, control compartment into which said main valve member subdivides said control chamber, and a first and second connecting compartment at the circumference of said main valve member intermediate said end faces and separate from each other and from said control compartments, said communicating means further including first duct means permanently communicating said second connecting and control compartments with said source for the pressurized actuating fluid to urge said main valve member toward said extended position thereof, second duct means communicating said first connecting compartment with said sink, third duct means communicating said source with said first control compartment, an auxiliary valve member interposed in said third duct means for displacement from a closed toward an open position, means for displacing said auxiliary valve member toward said open position thereof when said pumping piston is at said one end position thereof, fourth duct means communicating said first control compartment with said sink when said pumping piston is at said other position thereof, and fifth duct means communicating said one actuating compartment with said second connecting compartment in said retracted, and with said first connecting compartment in said extended, position of said main valve member.

2. A combination as defined in claim 1, wherein said medium is a liquid and said fluid is a gas; and wherein the active area of said actuating piston considerably exceeds that of said pumping piston.

3. A combination as defined in claim 1, wherein said first connecting compartment is closer to said second control compartment than said second connecting compartment; and wherein said first duct means includes a duct in said main valve member which bypasses said first connecting compartment and communicates said second control and connecting compartments with one another.

4. A combination as defined in claim 3, wherein said first connecting compartment has a longitudinal dimension exceeding that of said second connecting compartment to permanently communicate with said second duct means regardless of the position of said main valve member.

5. A combination as defined in claim 1, wherein said main valve member includes a land separating said connecting compartments from one another, at least one circumferential groove in said land, and a sealing ring in said groove.

6. A combination as defined in claim 5, wherein said main valve member further includes an additional groove in said land, and an additional sealing ring in said additional groove.

7. A combination as defined in claim 1, wherein said displacing means includes a displacing portion of said auxiliary valve member which extends into said one actuating compartment and into the path of reciprocation of said actuating piston to be displaced by the latter toward said open position when said pumping piston approaches said one end position.

8. A combination as defined in claim 7; and further comprising means for urging said auxiliary valve member toward said closed position.

9. A combination as defined in claim 1; and further comprising means for biasing said pumping piston toward said one end position thereof.

10. A combination as defined in claim 9, wherein said biasing means includes a spring accommodated in the other actuating compartment and acting on said actuating piston.

11. A combination as defined in claim 9; and further comprising a receiving chamber coaxially adjacent said one actuating compartment, and a guiding element rigid and coaxial with said actuating piston and extending into said receiving chamber.

12. A combination as defined in claim 11, wherein said fourth duct means communicates with said receiving chamber.

13. A combination as defined in claim 12, wherein said fourth duct means further includes a conduit communicating said receiving chamber with said sink; and wherein said guiding element obstructs said conduit until said pumping piston substantially reaches said other end position thereof.

14. A combination as defined in claim 1; further comprising a housing; wherein said pumping unit includes a pumping casing accommodated in said housing and having an extension extending to the exterior of said housing; and wherein said admitting and discharging means includes a valve casing, an admitting and a discharging valve accommodated in said valve casing, and means for detachably connecting said valve casing to said extension of said pumping casing, including a passage in said valve casing for fittingly receiving said extension.

15. A combination as defined in claim 14, wherein said connecting means further includes a pair of connecting elements each being of a doubly-conical configuration and each having a central channel communicating the interior of said extension with the interior of said valve casing at said admitting valve and at said discharging valve, respectively, and a pair of threaded members each respectively pressing one of said connecting elements into contact with said extension of said pumping casing.

16. A combination as defined in claim 1; and further comprising an additional pumping unit similar to said pumping unit and arranged to the other side of said actuating piston therefrom.

17. A combination as defined in claim 16; wherein said communicating means includes an additional auxiliary valve member similar to said auxiliary valve member and interposed in said fourth duct means, the displacing means of the additional auxiliary valve member being operative for displacing the latter toward said open position thereof when said pumping piston is at said other end position thereof.

18. A combination as defined in claim 17; and further comprising sixth duct means communicating said other actuating compartment with said source in said extended, and with said first connecting compartment in said retracted, position of said main valve member.

* * * * *